US009970197B2

(12) United States Patent
Maurer et al.

(10) Patent No.: US 9,970,197 B2
(45) Date of Patent: May 15, 2018

(54) MULTI-ELEMENT ROOFING OR SIDING PANEL

(71) Applicant: Tapco International Corporation, Wixom, MI (US)

(72) Inventors: Michael W. Maurer, Walled Lake, MI (US); Matthew Jason Michalski, Sylvan Lake, MI (US); Nathan D. Greenway, Attica, MI (US); Clyde G. Allen, Columbiaville, MI (US); Matthew M. Jackson, Saline, MI (US); Kyle P. O'Shea, Arvada, CO (US)

(73) Assignee: Tapco International Corporation, Wixom, MI (US)

( * ) Notice: Subject to any disclaimer, the term of this patent is extended or adjusted under 35 U.S.C. 154(b) by 0 days. days.

(21) Appl. No.: 15/718,684

(22) Filed: Sep. 28, 2017

(65) Prior Publication Data

US 2018/0016790 A1 Jan. 18, 2018

Related U.S. Application Data

(63) Continuation of application No. 14/727,084, filed on Jun. 1, 2015.

(60) Provisional application No. 62/008,427, filed on Jun. 5, 2014.

(51) Int. Cl.
*E04F 13/08* (2006.01)

(52) U.S. Cl.
CPC ..... *E04F 13/0864* (2013.01); *E04F 13/0869* (2013.01); *E04F 13/0873* (2013.01)

(58) Field of Classification Search
CPC .... E04F 13/08; E04F 13/0869; E04F 13/0873
See application file for complete search history.

(56) References Cited

U.S. PATENT DOCUMENTS 2,482,835 A * 9/1949 Bremer ..... E04D 1/06 52/533
2,766,706 A * 10/1956 Ludowici ..... E04D 1/04 52/533
3,579,940 A * 5/1971 Greenleaf ..... E04D 1/20 52/542
3,852,934 A * 12/1974 Kirkhuff ..... E04D 1/28 52/539
3,862,532 A * 1/1975 Markos ..... E04D 1/08 52/521

(Continued)

*Primary Examiner* — Andrew J Triggs
(74) *Attorney, Agent, or Firm* — Quinn IP Law

(57) ABSTRACT

A multi-element panel system configured for attachment to a mounting surface includes at least two panels. The panels each have an upper portion oriented upward and a lower portion oriented downward, relative to the mounting surface. A plurality of faces are formed on the panels and a plurality of keyways are formed between the faces. The keyways are recessed toward the mounting surface from the faces. The panels have a water trough, which has a planar intersection with the faces, formed on an exterior side of the upper portion, and a water channel extending between the upper and lower portions of one side of the panel. The panels have a side lap extending between the upper and lower portions on the opposite side of the panel from the water channel. The side lap of one of the panels overlaps the water channel of another, horizontally adjacent, panel.

8 Claims, 9 Drawing Sheets

(56) References Cited

U.S. PATENT DOCUMENTS

| | | | | | |
|---|---|---|---|---|---|
| 4,468,903 | A * | 9/1984 | Eaton | E04D 1/265 | 52/105 |
| 5,537,792 | A * | 7/1996 | Moliere | E04D 1/265 | 52/521 |
| 8,707,649 | B2 * | 4/2014 | Wilkie | E04F 13/0835 | 52/533 |
| 9,267,296 | B2 * | 2/2016 | Maurer | E04F 13/0894 | |
| 9,797,144 | B2 * | 10/2017 | Maurer | E04F 13/0846 | |
| 2008/0307738 | A1 * | 12/2008 | Lorenzon | E04D 1/08 | 52/521 |

* cited by examiner

MULTI-ELEMENT ROOFING OR SIDING PANEL

CROSS-REFERENCE TO RELATED APPLICATIONS

This application is a continuation of application Ser. No. 14/727,084, filed Jun. 1, 2015, which claims the benefit of U.S. Provisional Application No. 62/008,427, filed Jun. 5, 2014, both of which are hereby incorporated by reference in their entirety.

TECHNICAL FIELD

This disclosure relates to multi-tile or multi-element roofing or siding systems for attachment to mounting surfaces.

BACKGROUND

Exterior siding or roofing systems may include a plurality of tiles, panels, or combinations thereof. Generally, tiles simulate one or two individual decorative units and panels simulate a greater number of individual decorative units. For example, tiles or panels may emulate wooden shakes, wooden shingles, or slate tiles. However, the decorative units may be formed to simulate other siding or roofing materials, including stone, ceramics, et cetera.

SUMMARY

A multi-element panel system is provided. The panel system is configured for attachment to a mounting surface with a plurality of fasteners. Each of at least two panels includes an upper portion configured to be oriented upward relative to the mounting surface and a lower portion configured to be oriented downward relative to the mounting surface.

The panels have a plurality of faces formed thereon, and a plurality of keyways formed or defined between the faces. The keyways are recessed toward the mounting surface relative to the faces.

The panels further include a water trough and a water channel. The water trough is formed on an exterior side of the upper portion, and has a planar intersection with the faces. The water channel extends between the upper portion and the lower portion of one side of the panel.

The panels also include a side lap extending between the upper portion and the lower portion of the opposite side of the panel from the water channel. The side lap of one of the panels overlaps the water channel of another, horizontally adjacent, panel.

The above features and advantages, and other features and advantages, of the present disclosure are readily apparent from the following detailed description of some of the best modes and other embodiments for carrying out the invention, which is defined solely by the appended claims, when taken in connection with the accompanying drawings.

DETAILED DESCRIPTION

Figure 1:
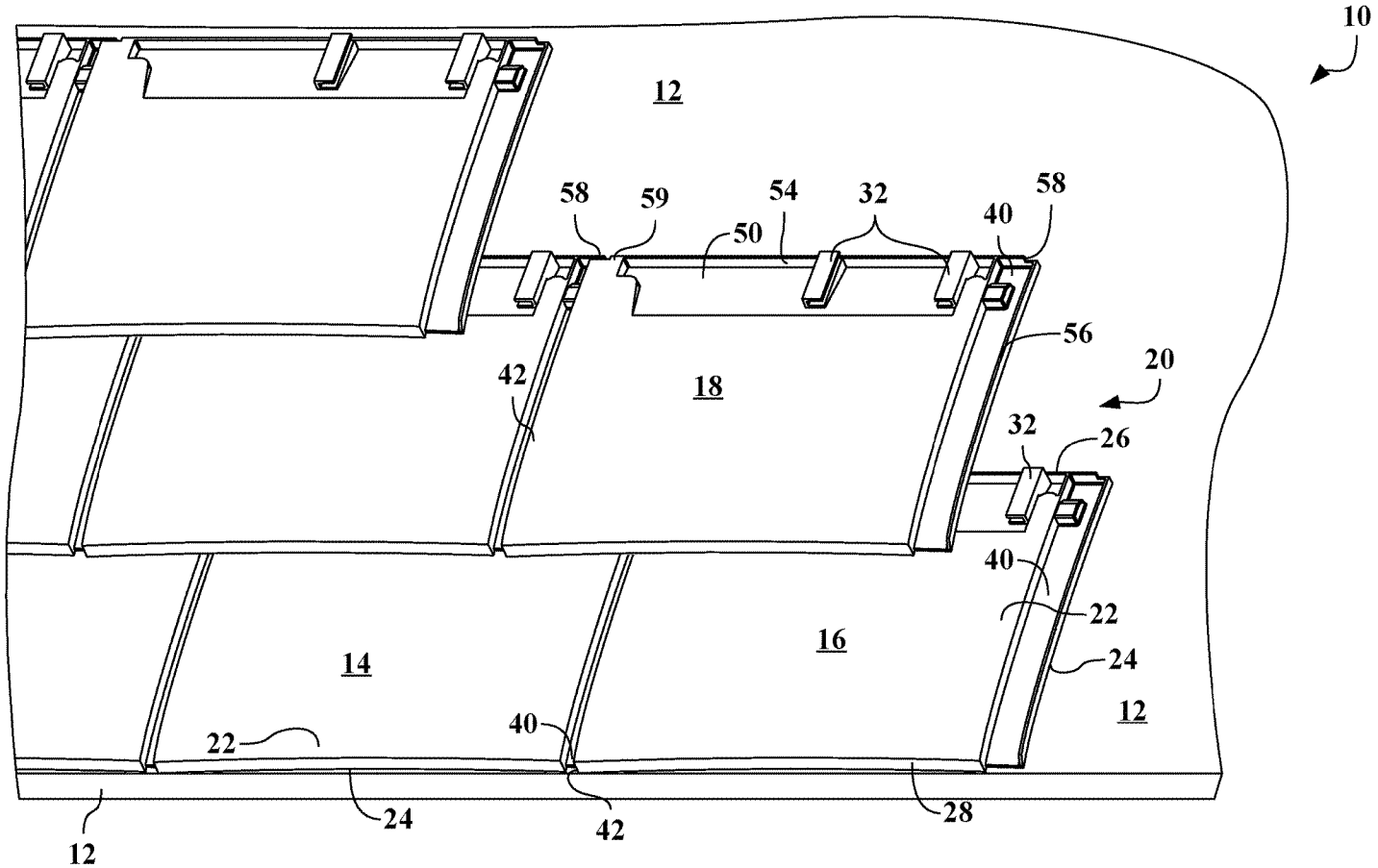
FIG. 1 is a schematic isometric view of a roofing system having a plurality of tiles.

Referring to the drawings, like reference numbers correspond to like or similar components wherever possible throughout the several figures. There is shown in FIG. 1 a roofing system or multi-tile system 10 for attachment to a mounting surface 12. The multi-tile system 10 may be attached to either roofs, vertical walls, or angled walls, such that the mounting surface 12 may be a wall or a roof.

The roofing system or multi-tile system 10 includes at least a first tile 14, a second tile 16, and a third tile 18. The second tile 16 and the third tile 18 have similar features to the first tile 14, such that they may be referred to collectively or generically as tiles 20.

An exterior side 22 of the tiles 20, which faces outward and away from the mounting surface 12, defines a forward direction or exterior face. An interior side 24 of the tiles 20, which faces downward toward the mounting surface 12, defines a rearward direction or interior face.

While the present subject matter may be described with respect to specific applications or industries, those skilled in the art will recognize broader applicability. Those having ordinary skill in the art will recognize that terms such as "above," "below," "upward," "downward," et cetera, are used descriptively of the figures, and do not represent limitations on the scope of the invention, as defined by the appended claims, unless stated otherwise. Any numerical designations, such as "first" or "second" are illustrative only and are not intended to limit the scope of the invention in any way.

Features shown in one figure may be combined with, substituted for, or modified by, features shown in any of the figures. Unless stated otherwise, no features, elements, or limitations are mutually exclusive of any other features, elements, or limitations. Furthermore, no features, elements, or limitations are absolutely required for operation. Any specific configurations shown in the figures are illustrative only and the specific configurations shown are not limiting of the claims or the description.

Figure 2:
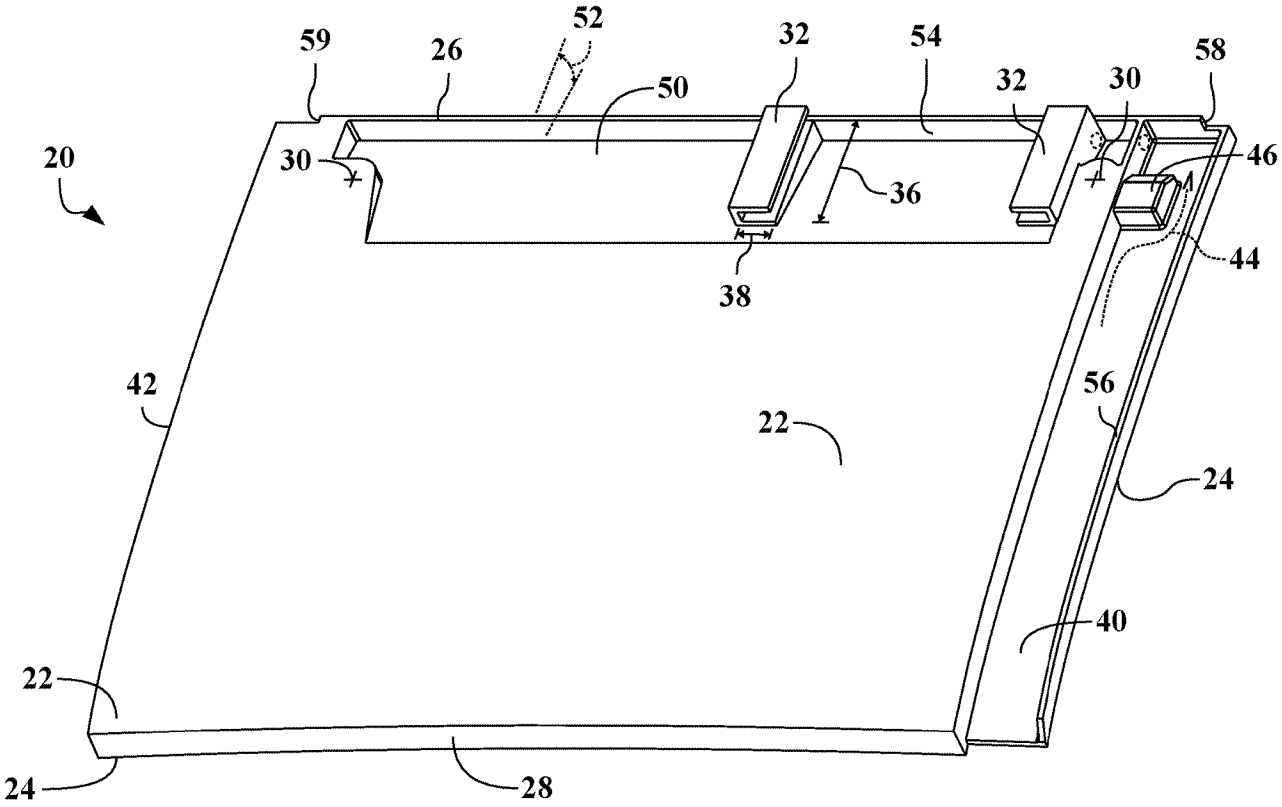
FIG. 2 is a schematic isometric view of an exterior side of one of the tiles shown in FIG. 1.
Figure 3:
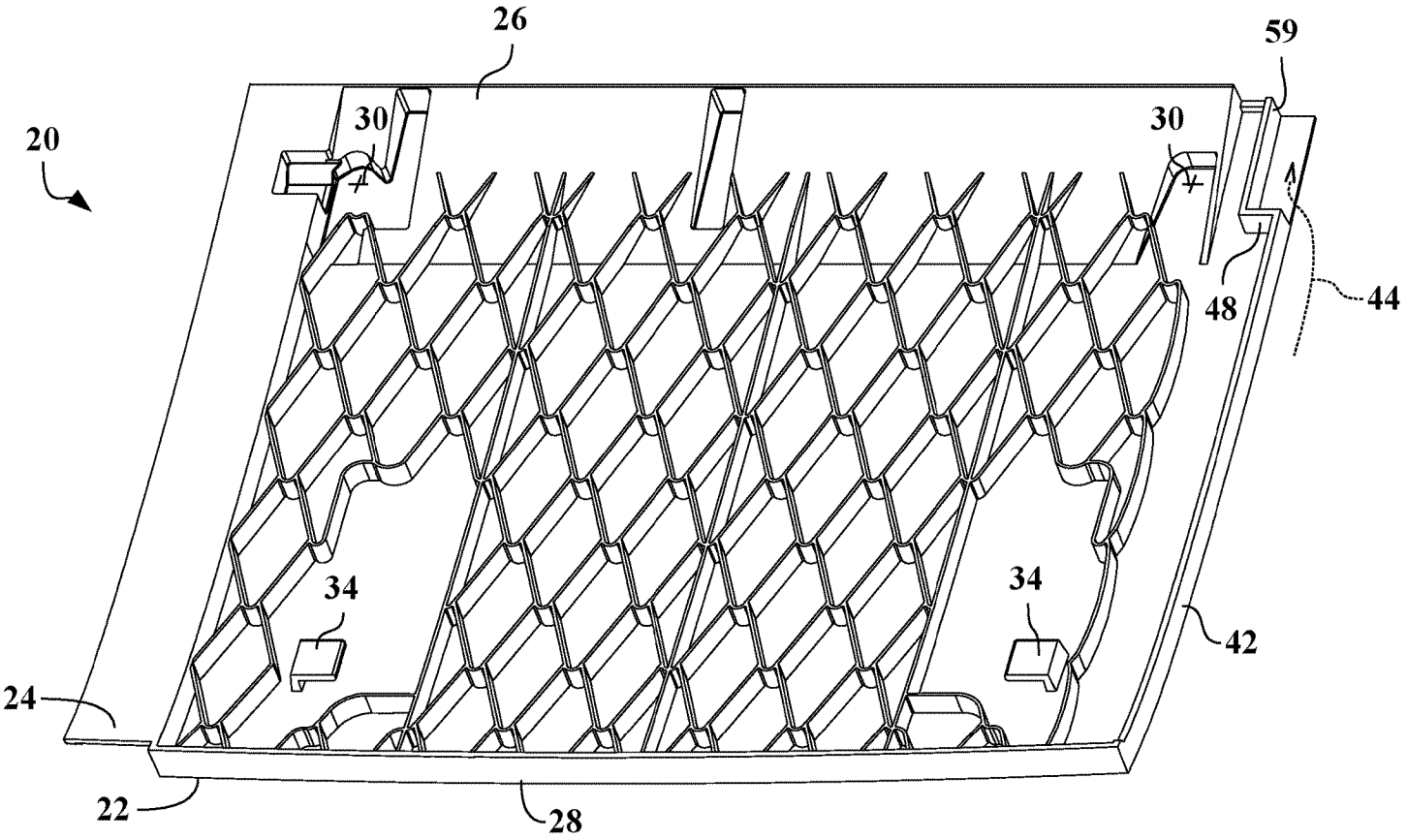
FIG. 3 is a schematic isometric view of an interior side of one of the tiles shown in FIG. 1.

Referring also to FIG. 2 and to FIG. 3, and with continued reference to FIG. 1, there are shown two schematic isometric views of tiles 20. Features of the first tile 14, the second tile 16, and the third tile 18 will be described with reference to FIG. 1, FIG. 2, and FIG. 3. The described features of the tile 20 shown in FIGS. 2 and 3 may refer to any of the first tile 14, the second tile 16, or the third tile 18. Note that manufacturing variance may lead to natural differences between the tiles 20 that are otherwise intended to be identical.

FIG. 2 shows the exterior side 22 of one of the tiles 20, and FIG. 3 shows the interior side 24 of one of the tiles 20. When assembled to the mounting surface 12, the exterior sides 22 and the interior sides 24 of the tiles 20 (as viewed in FIGS. 2 and 3, respectively) cooperate to lock the tiles 20 to the mounting surface with the assistance of one or more fasteners (not shown).

The tiles 20 include a fastener edge, upper portion, or upper edge 26 defined along one edge, which is shown on the top in FIGS. 2 and 3. A lap edge, lower portion, or lower edge 28 is defined opposite the upper edge 26, and is shown on a bottom or lower edge in FIGS. 2 and 3. The upper edge 26 may also be referred to as the head of the tile 20 and is lapped or overlapped by the lower edge 28 of subsequent tiles.

The exterior side 22 includes a face or fascia of the tiles 20. The face may be textured, painted, or surface-treated to simulate the look of different roofing materials. In many configurations of the tiles 20, the face will be configured to simulate the aesthetic look of slate, such that the multi-tile system 10 emulates natural slate roofing. However, the exterior sides 22 of the tiles 20 may also be configured to emulate other materials, such as, for example and without limitation: wooden shakes, wooden shingles, or ceramic tiles.

References to upper and lower directions, regions, or portions are generally defined relative to gravity and elevation as the tiles 20 are intended to be assembled to the mounting surface 12. Therefore, the typical flow direction of water or moisture over the tiles 20 and the structures to which they are mounted (although wind may cause water to move against gravity) is from the upper edge 26 toward the lower edge 28—i.e., top down. Similarly, vertical and horizontal are used descriptively relative to gravity and elevation. Horizontal is generally parallel to gravity and does not involve a change in elevation, while vertical is generally perpendicular to the horizontal direction and does involve a change in elevation.

At least some portion of the upper edge 26 contacts the mounting surface 12, possibly with an intermediary water barrier disposed therebetween. The upper edge 26 has a plurality of fastener holes 30 or fastener points defined therein.

The fastener holes 30 are configured to mount the tiles 20 to the mounting surface 12 with the fasteners, which may be nails, screws, staples, et cetera. In some embodiments, the fastener holes 30 may not be fully defined through the upper edge 26 but may instead be areas designated or identified for piercing by the fasteners, such that the fasteners at least partially pierce the material forming the tiles 20. Furthermore, the heads of the fasteners may stop at the face of the tile 20, as opposed to plunging into the face of the tile 20 or setting within a recess formed into the face of the tile 20.

The tiles 20 may be formed from different polymeric or composite materials. For example, and without limitation, the tiles 20 may be formed from polymers, reinforced resin, polypropylene, foamed polypropylene, high density polyethylene, low density polyethylene, combinations thereof, or other suitable materials. In many configurations, the tiles 20 may be formed as unitary, one-piece components, such that each tile 20 is a single component formed from a single piece of material without subsequent attachment of pieces formed separately. The tiles 20 may be formed via injection molding, compression molding, machining, or other suitable processes.

As best viewed in FIG. 3, the interior side 24 includes a system of ribs (not separately numbered), including filleted diamonds and vertical cut-line ribs. The filleted diamonds may provide additional structural rigidity and support for impact, such as from hail. Additionally, the filleted diamonds may prevent or limit movement of gases or liquefied material during extreme temperature events. The cut-line ribs may provide structural rigidity and convenient points for cutting the tiles 20 into partial tiles during installation of the multi-tile system 10, such that gaps on the interior side 24 are not viewable from the edges of partial tiles that are cut along the cut-line ribs.

A receiving member 32 is formed on the exterior side 22 of the upper edge 26, and a locking member 34 is formed on the interior side 24 of the lower edge 28. When the tiles 20 are assembled to the mounting surface 12, the receiving member 32 of a lower course (such as those on either the first tile 14 or the second tile 16 in FIG. 1) is covered or lapped by an upper course (such as the third tile 18).

Courses of tiles 20 refer to patterns or sets used during installation. In the example shown in the figures, each horizontal row is a separate course. A first course, which would include the first tile 14 and the second tile 16 in FIG. 1, is installed on the lowest portion of the mounting surface 12, possibly after installation of a starter strip or other prep structures, and then a second course, which would include the third tile 18 I FIG. 1, is subsequently installed above the first course.

The receiving member 32 of one tile 20, on the lower course, interlocks with the locking member 34 of another tile 20, on the upper course, to limit movement of the lower edge 28 of the upper tile 20 away from the upper edge 26 of the lower tile 20. Alternatively stated, the locking member 34 of the lower edge 28 is held to, or interlocked with, the receiving member 32 of the upper edge 26.

As used herein, interlocking between the receiving member 32 and the locking member 34 refers to at least some overlap between the receiving member 32 and the locking member 34, relative to the mounting surface 12. The receiving member 32 and the locking member 34 shown include cantilevered or overhanging portions, such that an opposing force resists separation of the receiving member 32 and the locking member 34.

Therefore, even though only the upper edges 26 of the tiles 20 are directly fastened to the mounting surface 12, both the lower edge 28 and the upper edge 26 are restrained to the mounting surface 12. Under wind loads that may otherwise pull the lower edge 28 of the tile 20 away from the mounting surface 12, the interlocking between the receiving member 32 and the locking member 34 helps keep all portions of the tiles 20 restrained to the mounting surface 12. These uplift forces are counteracted at the lower edge 28 without any fasteners driven through the lower edge 28.

Where the lower course of tiles 20, the horizontal row of FIG. 1 that includes the first tile 14, is the first course assembled to the mounting surface 12, there may also be a starter strip or other structure on the front edge of the mounting surface 12. The starter strip may include a set of receiving members 32 that interface with the locking members 34 of the first course, such that the starter strip emulate the upper portion of a course tiles 20 and interfaces with the first tile 14.

In the configuration shown in the figures, the receiving members 32 and the locking members 34 face inward toward each other and toward the center of the tiles 20. However, the receiving members 32 and the locking members 34 could also face outward.

The receiving members 32 and the locking members 34 are illustrated in the figures as formed from a single, continuous piece with the remainder of the tiles 20. However, in other configurations, either of the receiving members 32 or the locking members 34 could be formed as separate components and then subsequently attached to the remainder of the tiles 20. For example, the receiving members 32 could be formed individually, or as part of a larger piece, which are then snapped, adhered, or fastened to toward the upper edge 26.

Alternatively, the receiving members 32 could be formed attached to the upper edge 26 through a living hinge, and then folded to the positions shown. A living hinge may simplify manufacture of the tiles 20 by removing the need for lifters or retractable elements in the mold apparatus, while still maintaining proper draft in the injection-molding process for the tiles 20. The living hinge configuration may include a strip of material encompassing of the receiving members 32, which would then be nailed to the upper portion 26 as the tile 20 is nailed to the mounting surface 12.

The receiving member 32 and the locking member 34 provide continuous vertical adjustment through a vertical range 36, as opposed to incremental adjustment, such as that provided by boss-and-cavity or peg-and-hole systems. The continuous vertical adjustability of the tiles 20 may give the multi-tile system 10 a more-natural appearance, and provides the ability to adjust to different roof shapes, particularly those with multiple horizontal edges at differing vertical heights. The vertical range 36 provides elevational adjustment between tiles 20.

In the multi-tile system 10 shown, the receiving member 32 and the locking member 34 also cooperate to define a horizontal range 38, which provides continuous horizontal adjustment between the tiles 20. The horizontal range 38 is lesser than the vertical range 36, but still allows installers to vary the distance between adjacent tiles 20. Additional horizontal limitations between adjacent tiles 20 are provided by the interaction between the sides of the tiles 20, as discussed herein. Vertical and horizontal adjustability supports maximum and minimum exposure of the tiles 20, particularly vertical exposure, while maintaining proper lap to promote water flow.

The tiles 20 further include a gutter or water channel 40 formed on at least one side of the tiles 10 between the upper edge 26 and the lower edge 28. A side lap 42 is formed on the opposite side from the water channel 40. The side lap 42 is configured to overlap the water channel 40 of an adjacent tile 20. Interaction between the side lap 42 and the water channel 40 further limits the amount of horizontal adjustability between the tiles 20. When multiple tiles 20 are overlapped, the viewable, or exposed, portion of the water channel 40 forms a keyway between horizontally-adjacent tiles 20.

The tiles 20 include a serpentine path or S-path 44 in the side water channel 40. The S-path 44 forces water moving upward through the water channel 40, which may result from wind, to move around a horizontal dam 46. The S-path 44 reduces the likelihood of water reaching the uppermost edge of the water channel 40 and moving over the upper edge 26 onto the mounting surface 12 by forcing the water to move horizontally. The S-path 44 is a change in momentum of water moving through the water channel 40.

The water channel 40 is continuous and does not include any leaks, cracks, or nail points. Therefore, water within the water channel 40 cannot leak out of the water channel 40 without going over a ledge or flowing downward, as intended.

As viewed in FIG. 3, the side lap 42 also includes a horizontal ledge 48 that is configured to extend into the water channel 40 of an adjacent tile 20 to further restrict movement of water upward. The S-path 44 is shown in FIG. 3 to illustrate the general flow path when the tiles 20 are assembled or mated together.

The tiles 20 include a water trough 50 formed or defined on the upper edge 26. The water trough 50 is oriented at a trough angle 52 to the mounting surface 12 or to the exterior side 22 of the tile 20, such that there is no lip or ledge between the water trough 50 and the exterior side 22. The trough angle 52 allows water to flow downward from the water trough 50 onto the face of the exterior side 22 toward the lower edge 28, as opposed to trapping water in the water trough 50. Note that on the tiles 20 illustrated, the fastener points 30 are not formed in, or through, the water trough 50.

The trough angle 52 is configured to be substantially horizontal or flat, relative to gravity, when the tile 20 is assembled to the lowest pitch at which the multi-tile system 10 system is intended to be installed. For example, if the tiles 20 are configured to be installed to a minimum pitch of 3:12, which is three feet of rise per twelve feet of run, the trough angle 52 would be approximately fourteen-degrees. Note that when assembled to a steeper roof pitch, the trough angle 52 will also be steeper relative to gravity and drain more aggressively.

In some configurations of the tiles 20, the water trough 50 may have a flow channel or hole connecting to the water channel 40. This connection may allow water to drain from a least a portion of the water trough 50 into the water channel 40.

The tiles 20 shown include a trough lip 54 at the upper edge of the water trough 50. The trough lip 54 is substantially the full thickness of the tile 20 and may help prevent water, especially wind-blown water, from going over the back or top of the tile 20.

The thickness of the upper edge 26 and the lower edge 28 are substantially equal, such that the tiles 20 shown do not taper. Alternatively, some configurations of the tiles 20 may taper from front to back to reduce the amount of material used in the tile. However, such a taper may limit the depth of the water trough 50 and the height of trough lip 54.

The distance that the water trough 50 extends from the upper edge 26 to the face of the tile 20 may define the maximum vertical exposure of the multi-tile system 10. For example, and without limitation, the tiles 20 may have a vertical height of twelve inches and the water trough 50 may have a vertical length of three inches, such that the maximum vertical exposure of the tiles 20 is nine inches. The tiles 20 of an upper course generally must cover, or lap, the water trough 50 of the course just below.

The trough angle 52 and the height of the trough lip 54—based upon triangle-like geometry—may control the length of the water trough 50 and, therefore, may also control the amount of vertical exposure. Using the examples above, the trough lip 54 would be approximately 0.75 inches from the mounting surface 12 for the fourteen-degree trough angle 52 required for 3:12 roof pitch.

Horizontal adjustability and horizontal exposure may be controlled by the interaction between the water channel 40 and the side lap 42 of adjacent (side lapping) tiles 20. For absolute minimum, the side lap 42 may be pushed all the way through the water channel 40 until the water channel 40 is no longer viewable. However, such minimum exposure would negate the ability of the water channel 40 to emulate the natural keyway between, for example, slate tiles.

The tiles 20 include a channel lip 56 formed on one side of the water channel 40. The channel lip 56 limits the maximum horizontal exposure of the tiles 20 by cooperating with the side lap 42 to prevent pulling the side lap 42 beyond the water channel 40 and leaving a gap between horizontally-adjacent tiles 20.

The channel lip 56 also provides a barrier against which water must move to escape the water channel 40, similar to the function of the trough lip 54. The channel lip 56 and the trough lip 54 illustrated in the figures both provide water barrier features that are substantially perpendicular to the mounting surface, such that they require water to change momentum in order move over the edges of the tiles 20.

In the multi-tile system 10 shown, the tiles 20 include a channel notch 58 formed on the upper portion of the water channel, and a lap notch 59 formed on the upper portion of the side lap 42. The channel notch 58 and the lap notch 59 cooperate to limit the amount of the side lap 42 that can extend or overlap into the water channel 40, and ensure that some portion of the water channel 40 is viewable to simulate the keyway between horizontally-adjacent tiles. Therefore, in the tiles 20 shown, the channel notch 58 and the lap notch 59 define the minimum horizontal exposure by limiting how close adjacent tiles can be properly assembled.

Figure 4A:
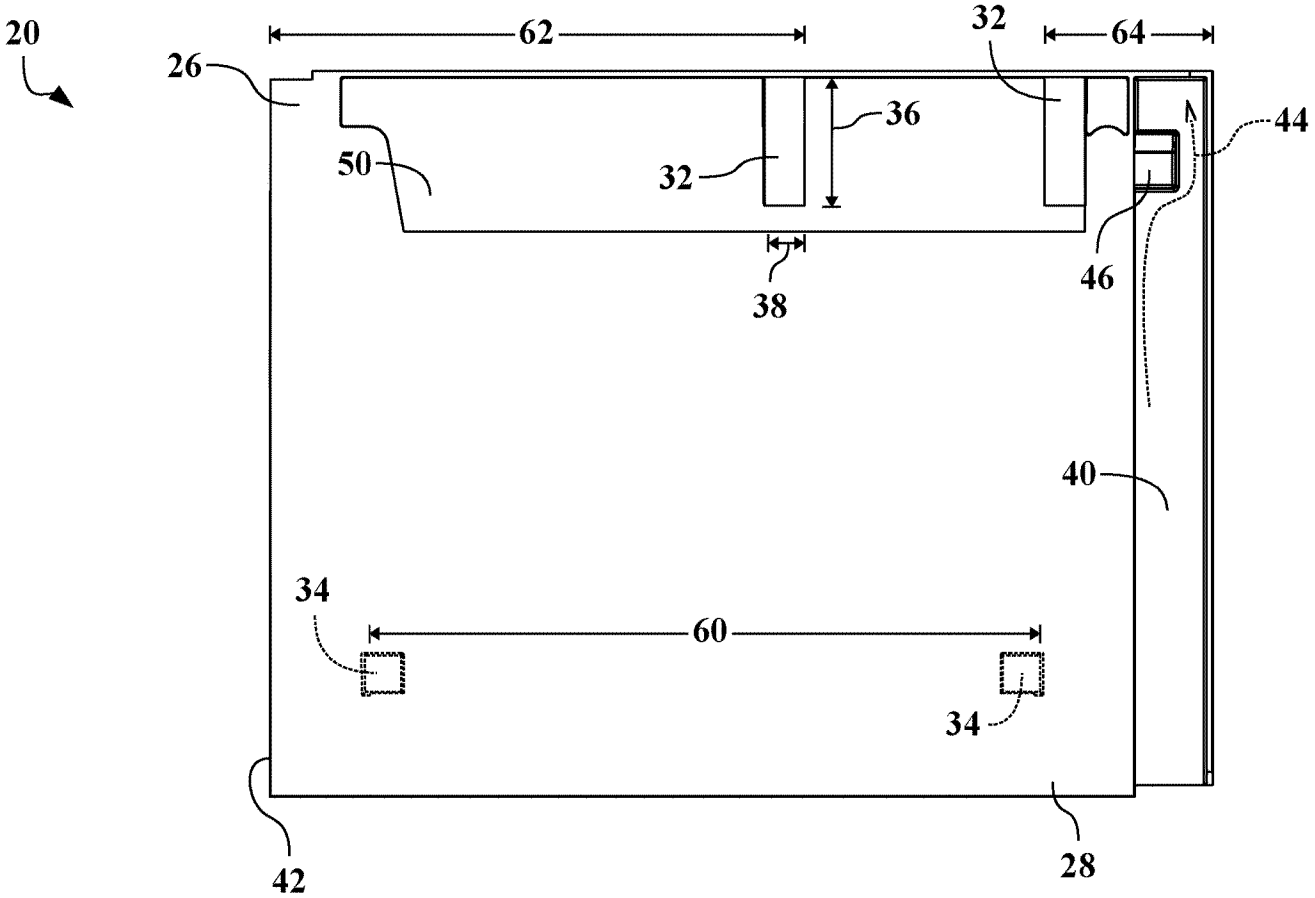
FIG. 4A is a schematic top view of one of the tiles in the roofing system, illustrating alignment of the interlocking features.
Figure 4B:
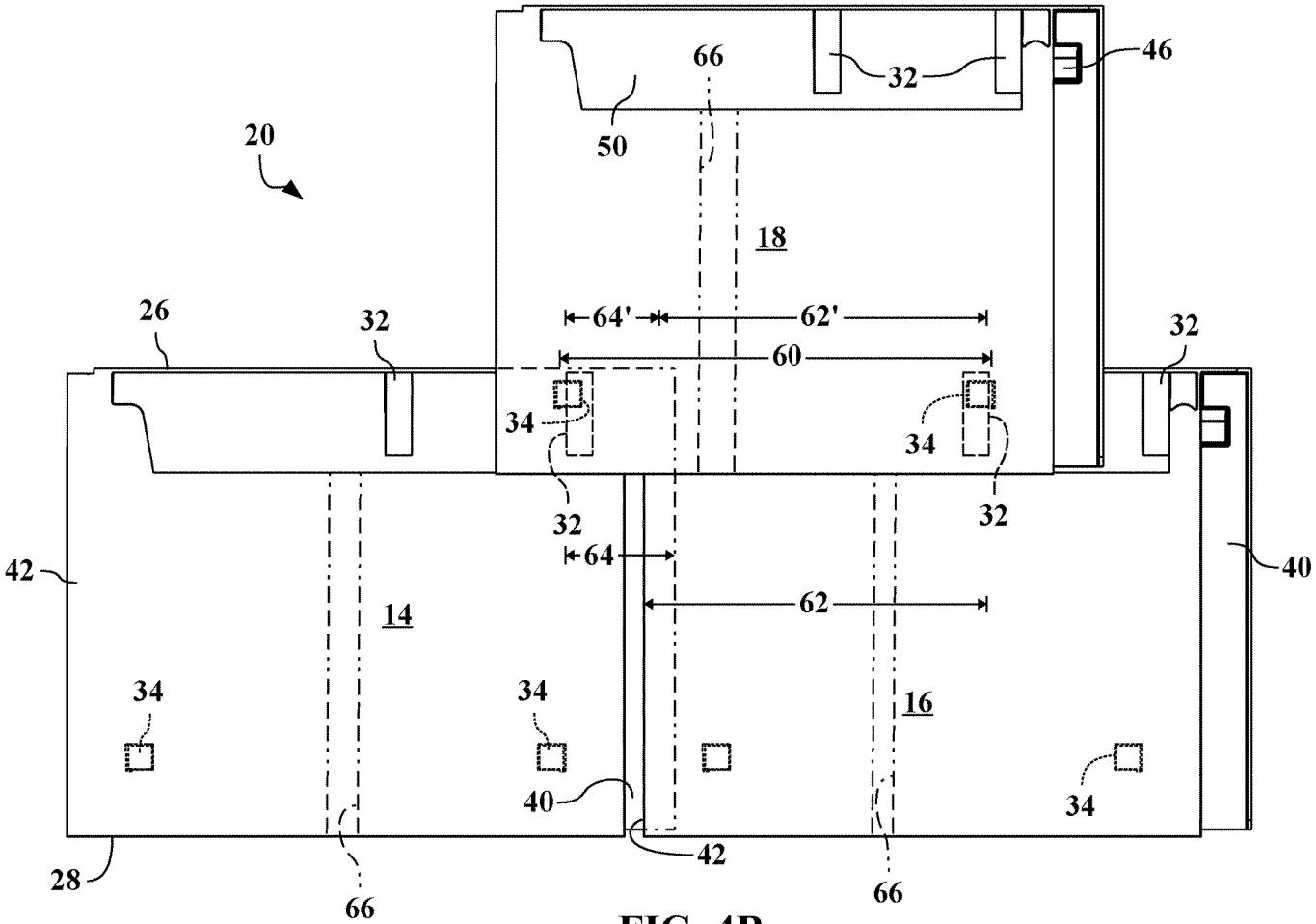
FIG. 4B is a schematic top view illustrating relative alignment of the tiles in the roofing system via interlocking elements.

Referring now to FIG. 4A and to FIG. 4B, and with continued reference to FIGS. 1-3, there are shown additional views of the tiles 20 illustrating alignment and interlocking. FIG. 4A shows a top view of one of the tiles 20, and FIG. 4B shows a top view of three tiles 20 aligned with, and assembled to, each other.

The locking members 34 are shown in dashed lines in both FIG. 4A and FIG. 4B. The locking members 34 are spaced apart by a locking span 60. The receiving members 32 are spaced from the edges of the tile 20 by a first offset 62 and a second offset 64.

The locking span 60 is smaller than the first offset 62 and the second offset 64 combined. Therefore, the locking members 34 are spaced at a smaller distance than the receiving members 32 are spaced from the edges of the tile 20, and also a smaller distance than the receiving member 32 of horizontally adjacent tiles 20. However, if the tiles 20 are assembled with proper side lapping, these distances change.

FIG. 4B illustrates proper horizontal and vertical lapping with the first tile 14 and the second tile 16 on the first (lower) course, and the third tile 18 on the second (upper) course. Note that the overlapped portion of the first tile 16 is shown in phantom. As shown in FIG. 4B, when the tiles 20 are assembled with the side lap 42 of the second tile 16 overlapping the water channel 40 of the first tile 14—such that the lower course has proper side lap—the receiving members 32 of the first tile 14 and the second tile 16 are able to interlock with the locking members 34 of the third tile 18. However, if the side lap 42 of the second tile 16 did not properly overlap the water channel 40 of the first tile 14, the locking members 34 of the third tile 18 would not be able to interlock with the receiving members 32 of the first tile 14 and the second tile 16.

The receiving members 32 of the first tile 14 and the second tile 16, both of which are shown in phantom, are spaced apart by a first effective offset 62' and a second effective offset 64'. The first effective offset 62' and the second effective offset 64' are measured from the centerline of the overlap between the first tile 14 and the second tile 16.

Therefore, as shown in FIG. 4B, the locking span 60 of the third tile 18 is greater than the combined offset of the first effective offset 62' and the second effective offset 64', such that the locking members 34 of the third tile 18 can interlock with the receiving members 32 of the first tile 14 and the second tile 16. If the tiles 20 of lower courses are not properly lapped, the tiles 20 of the subsequent courses will not be able to be interlocked with the lower courses because the locking span 60 will be less than the first offset 62 and the second 64 combined.

In FIG. 4B, the tiles 20 are illustrated with maximum, or near maximum, vertical exposure. Therefore, the maximum vertical amount of the first tile 14 and the second tile 16 are viewable below the third tile 18, and the water trough 50 of the first tile 14 is not viewable below the third tile 18.

The water channel 40 and the side lap 42 cooperate to define a viewable keyway between horizontally-adjacent tiles 20, such as that viewable between the first tile 14 and the second tile 16 in FIG. 1 and FIG. 4B. The tiles 20 may also include a simulated keyway 66 formed in the face of the tiles 20, as illustrated in phantom in FIG. 4B. The simulated keyway 66 may be located variably across the exterior side 22 of each the tiles 20, and the width of the simulated keyways 66 may be varied. The simulated keyways 66 may be formed on some, all, or none of the tiles 20.

The location of the receiving members 32 may be adjusted to the left or right of the upper edge 26 of the tiles 20. In the tiles 20 shown, the receiving members 32 are offset relative to the center of the tile 20, but may alternatively be symmetric about the tiles 20.

Using FIG. 1 and FIG. 4B as examples, assembly of the multi-tile system 10 may occur by aligning the first tile 14 to the mounting surface 12. The first tile 14 may be aligned with, for example and without limitation: edges of the mounting surface 12, with chalk lines applied to the mounting surface 12, with other alignment markers, or with previously-installed tiles 20. One or more fasteners may then be driven through the fastener points 30 of the first tile 14 into the mounting surface 12.

The second tile 16 may then be assembled to the first tile 14 by placing the side lap 42 over the water channel 40 of the first tile 14. The second tile 16 is horizontally aligned within the limits imposed by the water channel 40 and the side lap 42. The channel notch 58 and the lap notch 59 cooperate to maintain the minimum horizontal exposure and the channel lip 56 maintains the maximum exposure. Fasteners may then be inserted to lock the second tile 16 to the mounting surface 12.

The third tile 18 may then be aligned to the first tile 14 and the second tile 16. The locking members 34 of the third tile 18 may be interlocked with the receiving members 32 of the first tile 14 and the second tile 16. Note that if the second tile 16 were incorrectly installed, such that the side lap 42 of the second tile 16 does not overlap the water channel 40 of the first tile 14, the receiving members 32 of the first tile 14 and the second tile 16 will be spaced too far apart to allow the locking members 34 of the third tile 18 to interlock therewith.

The horizontal and vertical alignment of the third tile 16 will be limited by the ability of the locking members 34 and the receiving members 32 to interlock. The third tile 16 is oriented such that the first tile 14 and the second tile 16 have nearly maximum vertical exposure. Fasteners may then be inserted to lock the upper edge 26 of the third tile 18 to the mounting surface 12. Interlocking between the locking members 34 of the third tile 18 and the receiving members 32 of the first tile 14 and the second tile 16 will hold the lower edge 28 of the third tile 18 to the mounting surface 12.

Figure 5:
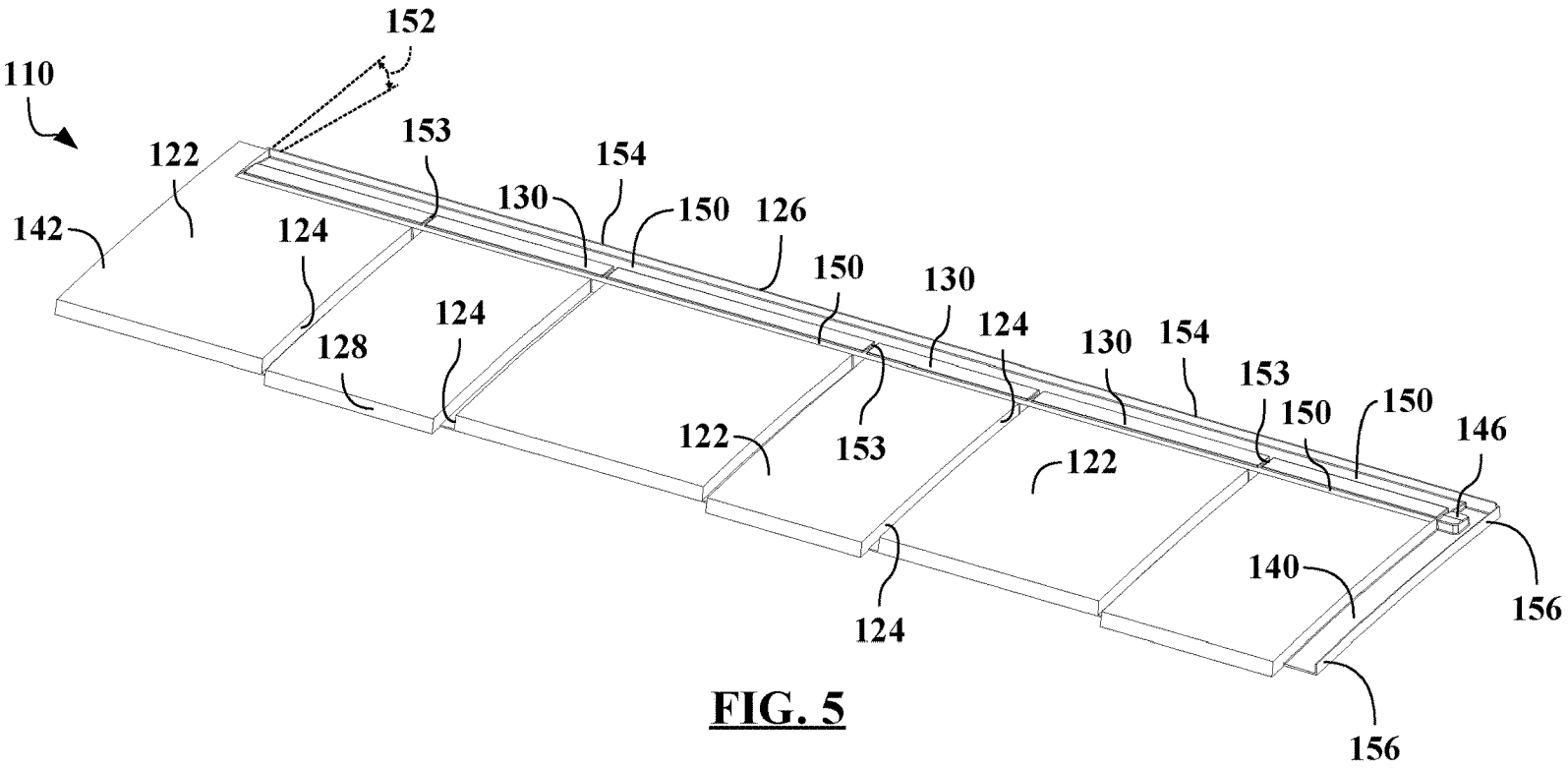
FIG. 5 is a schematic isometric view of an exterior side of a multi-element panel for attachment to a mounting surface.
Figure 6:
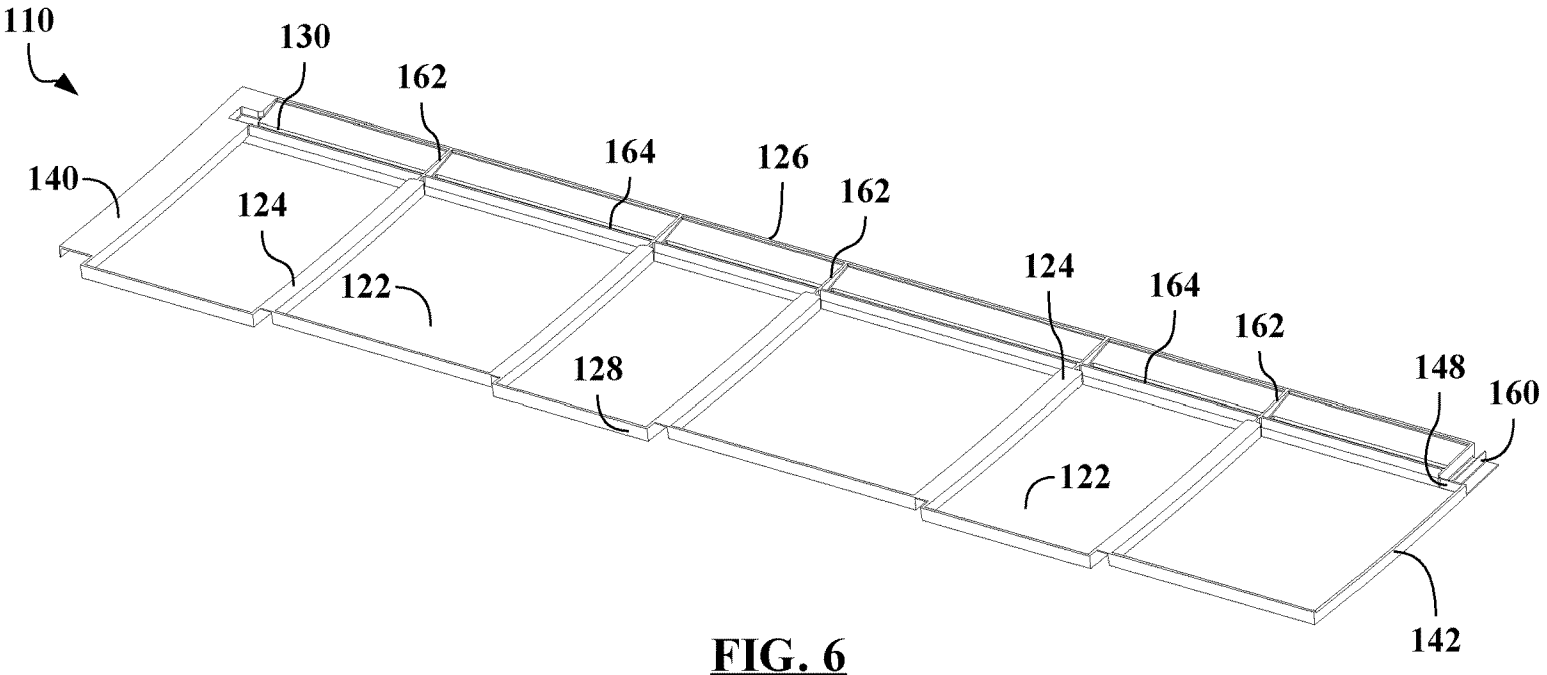
FIG. 6 is a schematic isometric view of an interior side of the multi-element panel shown in FIG. 5.

Referring to FIG. 5 and to FIG. 6, and with continued reference to FIGS. 1-4B, there are shown two schematic isometric views of a multi-element panel 110. An exterior side of the panel 110, which faces outward and away from the mounting surface (not shown), defines a forward direction or exterior face. An interior side of the panel 110, which faces downward toward the mounting surface, defines a rearward direction or interior face. A plurality of the panels 110 may be assembled to form a roofing or siding system.

FIG. 5 shows the exterior side of one of the panels 110, and FIG. 6 shows the interior side of one of the panels 110. The exterior side includes a plurality of faces 122 of the panel 110. The faces 122 may be textured, painted, or surface-treated to simulate the look of different roofing materials. Further defining the multiple elements, the panel 110 also includes a plurality of keyways 124, which separate several of the faces 122. The keyways 124 are recessed from the faces 122 and extend downward from the faces 122 toward the mounting surface.

In many configurations of the panel 110, the faces 122 will be configured to simulate the aesthetic look of a plurality of natural slate tiles; such that the panel 110, or a number of panels 110 assembled to the mounting surface, emulates natural slate roofing. Therefore, the keyways 124 simulate the aesthetic look of the gaps (or keyways) between individual slate tiles in each horizontal course. However, the exterior sides of the panel 110 may also be configured to emulate other materials, such as, for example and without limitation: wooden shakes, wooden shingles, or ceramic tiles.

The panel 110 includes a fastener edge, upper portion, or upper edge 126 defined along one edge, which is shown toward the top in FIGS. 5 and 6. A lap edge, lower portion, or lower edge 128 is defined opposite the upper edge 126, and is shown on a bottom or lower edge in FIGS. 5 and 6. The upper edge 126 may also be referred to as the head of the panel 110 and is lapped or overlapped by the lower edge 128 of subsequent tiles when installed.

References to upper and lower directions, regions, or portions are generally defined relative to gravity and elevation as the panels 110 are intended to be assembled to the mounting surface. The upper edge 126 and the lower edge 128 are also defined relative to the slope of the mounting surface, such that the upper edge 126 is higher, relative to gravity, when installed and the lower edge 128 is lower, relative to gravity, when installed. Therefore, the typical flow direction of water or moisture over the panels 110 and the structures to which they are mounted (although wind may cause water to move against gravity) is from the upper edge 126 toward the lower edge 128—i.e., top down.

Similarly, vertical and horizontal are used descriptively relative to gravity and elevation. Horizontal is generally parallel to gravity and does not involve a change in elevation, while vertical is generally perpendicular to the horizontal direction and does involve a change in elevation.

As shown in FIGS. 5 and 6, the faces 122 may have varying lengths, such that the lower edge 128 is at varied distance from the upper edge 126. The faces 122, therefore, further simulate the appearance of natural slate tiles or wooden shakes, which may have varied lengths or be installed with slight variations on the mounting surface. Note that the panel 110 shown has only two different lengths of the faces 122, but may have several random lengths.

The keyways 124 may be located along the panel 110 based upon an algorithm designed to result in the appearance of randomized locations between variable-width, natural state tiles or wooden shakes. In a roofing system of multiple panels 110, several different panels 110, having different patterns or locations of the keyways 124 between the faces 122, may be used to further simulate the look of natural elements hand-selected and assembled to the mounting surface. Furthermore, the width of the keyways 124 may be varied based upon an algorithm to simulate the spacing between natural state tiles or wooden shakes.

At least some portion of the upper edge 126 contacts the mounting surface, possibly with an intermediary water barrier disposed therebetween. The upper edge 126 has one or more fastener hems or fastener strips 130 or fastener points defined therein.

The fastener strips 130 are configured to mount the panel 110 to the mounting surface with a plurality of fasteners (not shown), which may be nails, screws, staples, et cetera. In some embodiments, the fastener strips 130 may be areas designated or identified for piercing by the fasteners, such that the fasteners at least partially pierce the material forming the panel 110. Furthermore, the heads of the fasteners may stop at the face of the panel 110, as opposed to plunging into the face of the panel 110 or setting within a recess formed into the face of the panel 110. As shown in FIGS. 5 and 6, the fastener strips 130 may be elevated, raised, or offset from the exterior side of the panels 110.

The panel 110 may be formed from different polymeric or composite materials. For example, and without limitation, the panel 110 may be formed from polymers, reinforced resin, polypropylene, foamed polypropylene, high density polyethylene, low density polyethylene, combinations thereof, or other suitable materials. In many configurations, the panel 110 may be formed as unitary, one-piece components, such that each panel 110 is a single component formed from a single piece of material without subsequent attachment of pieces formed separately. The panel 110 may be formed via injection molding, compression molding, machining, or other suitable processes.

The underside of the faces 122, the keyways 124, and the fastener strips 130 are viewable in FIG. 6. Although not shown, the interior side of the panels 110 may include a system of ribs, similar to those shown in FIG. 3, including filleted diamonds and vertical cut-line ribs. The cut-line ribs may provide structural rigidity and convenient points for cutting the panel 110 into partial tiles during installation of the multi-tile system 110, such that gaps on the interior side are not viewable from the edges of partial tiles that are cut along the cut-line ribs. Because the panel 110 includes multiple elements, there are a large number of possible cut lines for making partial panels to start or finish a horizontal course during installation. Therefore, each element may have multiple cut-line ribs between the keyways 124.

The panels 110 are configured to be sufficiently rigid to resist wind uplift forces, particularly at the lower edge 128, without an interlock between vertically-adjacent panels 110 and without any fasteners driven through the lower edge 128. Therefore, only the upper edge 126 includes fasteners driven through the fastener strips 130. The keyways 124, and particularly the walls thereof, provide additional structural rigidity by acting as ribs on the underside of the panels 110, as viewed in FIG. 6. Furthermore, the panels 110 may include additional ribs.

The panels 110 further include a gutter or water channel 140 formed on at least one side of the panels 110 between the upper edge 126 and the lower edge 128. A side lap 142 is formed on the opposite side of the panel 110 from the water channel 140. The side lap 142 is configured to overlap the water channel 140 of an adjacent panel 110. In FIG. 5, the water channel 140 is toward the right and the side lap 142 is toward the left.

Interaction between the side lap 142 and the water channel 140 limits the amount of horizontal, and possibly vertical, adjustability between the panels 110. When multiple panels 110 are overlapped, the viewable, or exposed, portion of the water channel 140 forms a keyway between horizontally-adjacent panels 110.

The panels 110 force a serpentine path or S-path in the side water channel 140. The S-path forces water moving upward through the water channel 140, which may result from wind, to move around a horizontal dam 146. The S-path reduces the likelihood of water reaching the uppermost edge of the water channel 140 and moving over the upper edge 126 onto the mounting surface by forcing the water to change momentum and move horizontally before reaching the upper edge of the water channel 140.

The water channel 140 is continuous and does not include any holes, cracks, or nail points. Therefore, water or moisture within the water channel 140 cannot leak out of the water channel 140 without going over a ledge or flowing downward, as intended. Instead, water flows downward through the water channel 140 onto the face 122 of a lower panel 110 or off of the edge of the mounting surface.

As viewed in FIG. 6, the side lap 142 includes a horizontal ledge 148 that is configured to extend into the water channel 140 of an adjacent panel 110 to further restrict movement of water upward. The horizontal ledge 148 and the horizontal dam 146 of adjacent panels 110 cooperate to force water to change momentum and provide a significant barrier against water reaching, and moving over, the upper edge 126 onto the mounting surface.

The panels 110 include a water trough 150 formed or defined on the upper edge 126. The water trough 150 is oriented at a trough angle 152 to the mounting surface or to the exterior side of the panel 110, and there is no lip or ledge between the water trough 150 and the exterior side. The water trough 150 is substantially planar and has a planar intersection abutting to the faces 122, such that water simply has to flow over the linear edge connecting the water trough 150 to the faces 122 and the keyways 124, and is not trapped within the water trough 150. The fastener strips 130 extend upward from within the water trough 150.

The trough angle 152 allows water to flow downward from the water trough 150 onto the faces 122 of the exterior side toward the lower edge 128, as opposed to trapping water in the water trough 150. On the panels 110 illustrated, the fastener strips 130 are raised slightly above the water trough 150, which provides further protection against moisture moving upward on the panel 110 from reaching holes around the fasteners.

The trough angle 152 is configured to be substantially horizontal or flat, relative to gravity, when the panel 110 is assembled to the lowest pitch at which the multi-tile system 110 system is intended to be installed. For example, if the panels 110 are configured to be installed to a minimum pitch of 3:12, which is three feet of rise per twelve feet of run, the trough angle 152 would be approximately fourteen-degrees. Note that when assembled to a steeper roof pitch, the trough angle 152 will also be steeper relative to gravity and drain more aggressively.

A plurality of weeping channels 153 are formed through the fastener strips 130 to link the portions of the water trough 150 and the lower portions of the panels 110. The weeping channels 153 allow water to drain from all portions of the water trough 150 to the either the faces 122 or the keyways 124. As shown in the figures, the weeping channels 153 are coplanar with the water trough 150 and pass water between the portions of the water trough 150 above the nailing strips 130 and below the nailing strips 130, such that the weeping channels 153 may be considered portions of the water trough 150 or linking elements between the water trough 150.

The weeping channels 153 shown are substantially aligned with the keyways 124, although offset from the keyways 124 by the lower portion of the water trough 150. However, the weeping channels 153 may also be located with consistent spacing along the horizontal length of the panel 110, such as the average shingle distance, such that some of the weeping channels 153 are aligned with the faces 122.

In some configurations of the panels 110, such as that shown in FIG. 5, the water trough 150 has a flow path or connection to the water channel 140. This connection may allow water to drain from at least a portion of the water trough 150 into the water channel 140, further preventing water from collecting in the water trough 150.

The panels 110 shown include a trough lip 154 at the upper edge 126 of the water trough 150. The trough lip 154 is substantially the full thickness of the panel 110 and may help prevent water, especially wind-blown water, from going over the back or top of the panel 110.

The thickness of the upper edge 126 and the lower edge 128 are substantially equal, such that the panels 110 shown do not taper. Alternatively, some configurations of the panels 110 may taper from front to back to reduce the amount of material used in the panels 110. However, such a taper may limit the depth of the water trough 150 and the height of trough lip 154.

The distance that the water trough 150 extends from the upper edge 126 to the face 122 of the panel 110 may define the maximum vertical exposure of the multi-tile system 110. The trough angle 152 and the height of the trough lip 154—based upon triangle-like geometry—may control the length of the water trough 150 and, therefore, may also control the amount of vertical exposure.

Exposure refers to the amount of any panel 110 that is viewable after installation in the roofing system. Maximum exposure results in more of each panel 110 being visible and requires relatively fewer panels 110 to cover the same space. Minimum exposure results in less of each panel 110 being visible and requires relatively more panels 110 to cover the same space.

Horizontal adjustability and horizontal exposure may be controlled by the interaction between the water channel 140 and the side lap 142 of horizontally adjacent (side lapping) panels 110. For absolute minimum, the side lap 142 may be pushed all the way through the water channel 140 until the water channel 140 is no longer viewable. However, such minimum exposure would negate the ability of the water channel 140 to emulate the keyway, which may be visually similar to one of the keyways 124, between natural elements.

The panels 110 include a channel lip 156 formed on one side of the water channel 140. The channel lip 156 limits the maximum horizontal exposure of the panels 110 by cooperating with the side lap 142 to prevent pulling the side lap 142 beyond the water channel 140 and leaving a gap between horizontally-adjacent panels 110.

The channel lip 156 also provides a barrier that water must move over to escape the water channel 140, similar to the function of the trough lip 154. The channel lip 156 and the trough lip 154 illustrated in the figures both provide water barrier features that are substantially perpendicular to the mounting surface, such that they require water to change momentum and move against gravity in order move over the edges of the panels 110.

In the multi-element panel roofing system shown, the panels 110 include a lap spacer 160 formed on the upper portion of the side lap 142. When two panels 110 are assembled together, the lap spacer 160 cooperates with the horizontal dam 146 of the adjacent panel 110 to limit the amount of the side lap 142 that can extend or overlap into the water channel 140, and ensures that some portion of the water channel 140 is viewable to simulate the keyway between horizontally-adjacent tiles. The lap spacer 160 also cooperates with the trough lip 154 to limit the maximum exposure of the water channel 140.

If the lap spacer 160 were not formed on the interior side of the panels 110, the minimum exposure would allow the water channel 140 to be completely blocked from view and the maximum exposure would allow the whole water channel 140 to be viewable. Therefore, in the panels 110 shown, the lap spacer 160 defines both the minimum and maximum horizontal exposure of properly assembled panels 110.

Uplift at the lower edge 128 creates torque about the connection, at the fastener strips 130, between the panel 110 and the mounting surface. As shown in FIG. 6, the panels 110 include a plurality of counter ribs 162 that continue from the underside of the keyways 124 to the upper edge 126. In the configuration shown, the counter ribs 162 are aligned below the weeping channels 153. The counter ribs 162 promote rigidity and counteract torque generated about the fastener strips 130 by uplift loads at the lower edge 128.

A plurality of fastener ribs 164 may provide support against the loads introduced by fasteners driven through the fastener strips 130. The fastener ribs 164 may also provide torsional rigidity by horizontally linking the keyways 124.

Figure 7:
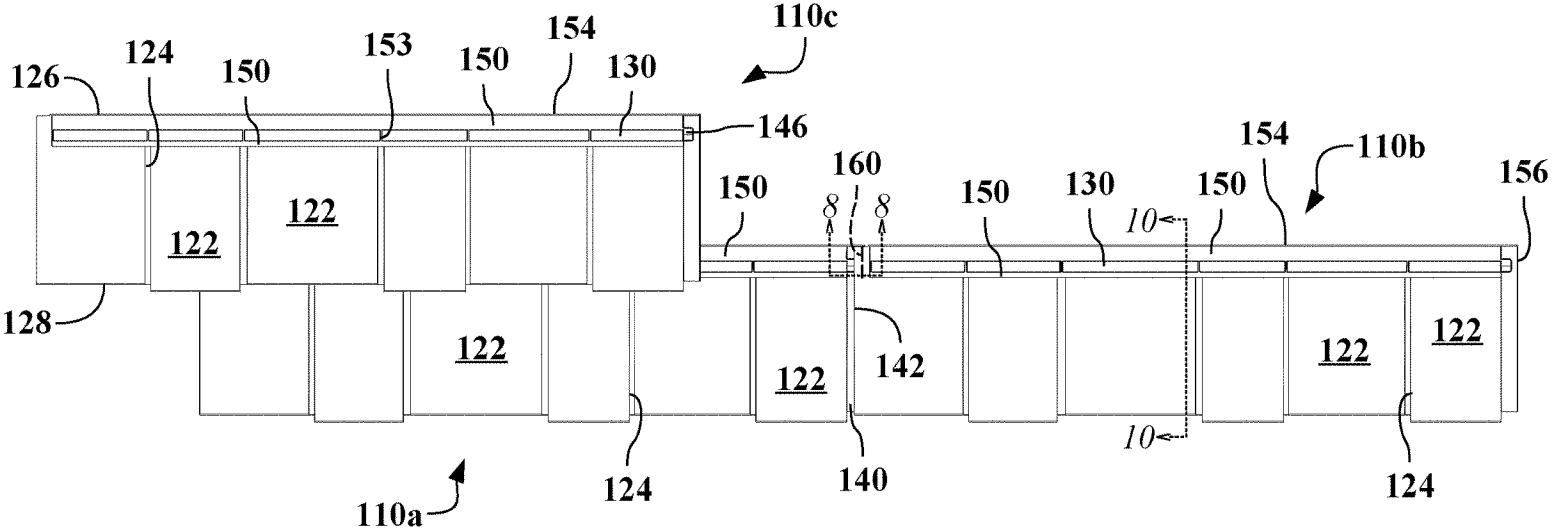
FIG. 7 is a schematic top view illustrating relative alignment of several multi-element panels assembled to a roofing system.
Figure 8B:
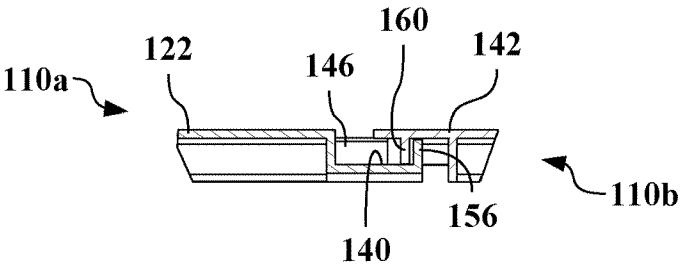
FIG. 8B is another schematic partial cross section illustrating relative interaction or overlapping between adjacent panels, taken generally along the line 8-8 from FIG. 7, with the panels aligned at substantially maximum horizontal exposure.
Figure 8A:
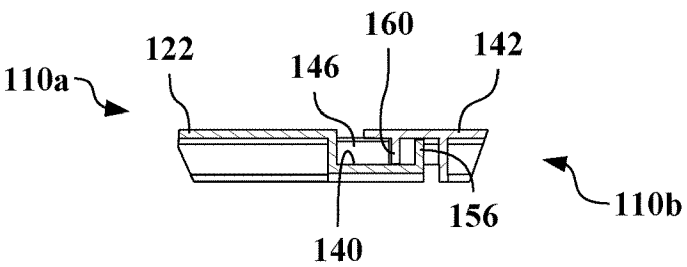
FIG. 8A is a schematic partial cross section illustrating relative interaction or overlapping between adjacent panels, taken generally along a line 8-8 from FIG. 7, with the panels aligned at substantially minimum horizontal exposure.

Referring to FIG. 7, to FIG. 8A, and to FIG. 8B, and with continued reference to FIGS. 1-6, there are shown two additional views of a plurality of panels 110. FIG. 7 shows a top view of three panels 110 illustrating relative alignment for installation. FIG. 8A shows a cross-sectional view of the side lap between two of the panels 110, aligned at substantially minimum horizontal exposure, taken generally along the line 8-8, and FIG. 8B shows a similar cross-sectional view of the side lap between two of the panels 110, but aligned at substantially maximum horizontal exposure, taken generally along the line 8-8.

During installation of the roofing system, a first panel 110*a* may be attached to the mounting surface (not numbered). A second panel 110*b* may then be aligned to the right of the first panel 110*a* and also attached to the mounting surface with a plurality of fasteners. The first panel 110*a* and the second panel 110*b* are part of a first course of panels that are generally aligned along a horizontal row. A third panel 110*c* may then be aligned and assembled in a row above the first panel 110*a* and the second panel 110*b*.

The third panel 110*c* covers the water trough 150 of the panels 110 over which it is installed. In the illustration shown in FIG. 7, the third panel 110*c* overlaps only the upper portion 126 of the first panel 110*a*. However, depending on the pattern of installation and whether the first panel 110*a* or third panel 110*c* are beginning a row, the third panel 110*c* may overlap both the first panel 110*a* and the second panel 110*b*.

As viewed in FIGS. 7, 8A, and 8B, the side lap 142 of the second panel 110*b* overlaps the water channel 140 of the first panel 110*a*. FIGS. 8A and 8B show an upward viewpoint of the lap between the first panel 110*a* and the second panel 110*b* at different horizontal exposures. Courses of the panels 110 are horizontally offset relative to the course below and the course above, as illustrated in FIG. 7.

During installation, the side lap 142 of the second panel 110*b* is laid over the water channel 140 of the first panel 110*a*, such that portions of the side lap 142 extend into, and affect water flow through, the water channel 140. The lap spacer 160 of the second panel 110*b* is shown with a dashed line in FIG. 7.

The lap spacer 160 of the second panel 110*b* may abut the horizontal dam 146 of the first panel 110*a* for minimum horizontal exposure and may abut the channel lip 156 of the first panel 110*a* for maximum horizontal exposure. The panels 110 are illustrated in FIG. 8A at or near minimum horizontal exposure between the first panel 110*a* and the second panel 110*b*, with the lap spacer 160 of the second panel 110*b* nearly in contact with the horizontal dam 146 of the first panel 110*a*. In this orientation, relatively less of the water channel 140 is viewable, and simulates a relatively small keyway between elements.

The panels 110 are illustrated in FIG. 8B (and also in FIG. 7) at or near maximum horizontal exposure between the first panel 110*a* and the second panel 110*b*, such the lap spacer 160 of the second panel 110*b* is nearly in contact with the channel lip 156 of the first panel 110*a*. In this orientation, nearly the maximum amount of the water channel 140 is viewable to simulate a relatively large keyway between elements. FIGS. 8A and 8B show two of the possible configurations or alignments of the panels 110 between minimum horizontal exposure and maximum horizontal exposure, such that the overlap of the panels is continuously variable between the minimum horizontal exposure and the maximum horizontal exposure.

If the lap spacer 160 were not formed on the interior side of the panels 110, the minimum horizontal exposure would allow the water channel 140 to be completely blocked from view, as the second panel 110*b* would be moved further leftward in FIG. 7, and the maximum exposure would allow the whole water channel 140 to be viewable, as the second panel 110*b* would be moved further rightward in FIG. 7. Therefore, in the panels 110 shown, the lap spacer 160 cooperates to define both the minimum and maximum horizontal exposure of properly assembled panels 110.

Figure 9:
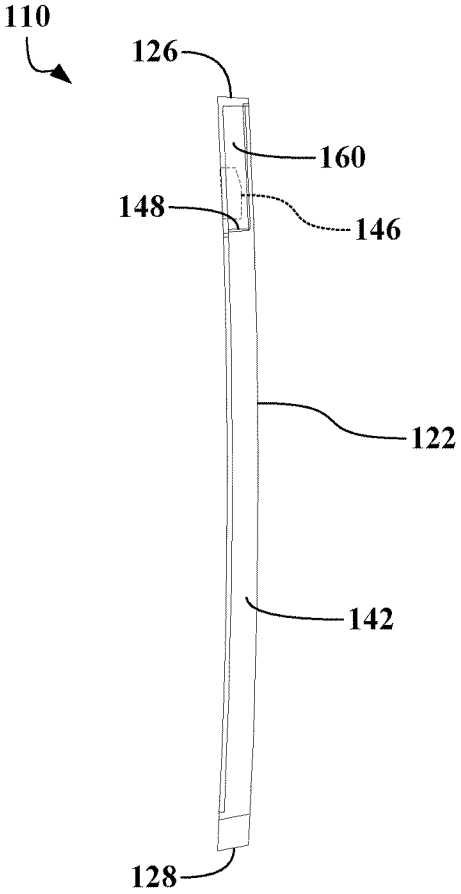
FIG. 9 shows a schematic side view of one of the panels, illustrating a side lap, which is configured to overlap a horizontally-adjacent panel.

Referring also to FIG. 9, there is shown a side view of the panels 110, such as the left side (as viewed in FIG. 7). In FIG. 9, the horizontal ledge 148 is shown on the side lap 142, as is the lap spacer 160, which is recessed slightly from the leftward edge of the panel 110.

When the panels 110 are assembled together, the horizontal dam 146 (shown schematically in dashed lines) of an overlapped panel 110 sits just above the horizontal ledge 148, as shown in FIG. 9. Therefore, water attempting to move upward toward the upper edge 126 will be forced to move horizontally between the horizontal ledge 148 and the horizontal dam 146, forming the S-path. In other words, water moving up the water channel 140 (not shown in FIG. 9) cannot move in a continuous vertical path, but must change direction (and momentum) to reach the upper edge 126 of the water channel 140. This horizontal passage requirement is also illustrated by the horizontal dam 46 and the horizontal ledge 48 forcing the S-path 44 in FIGS. 2 and 3.

Figure 10:
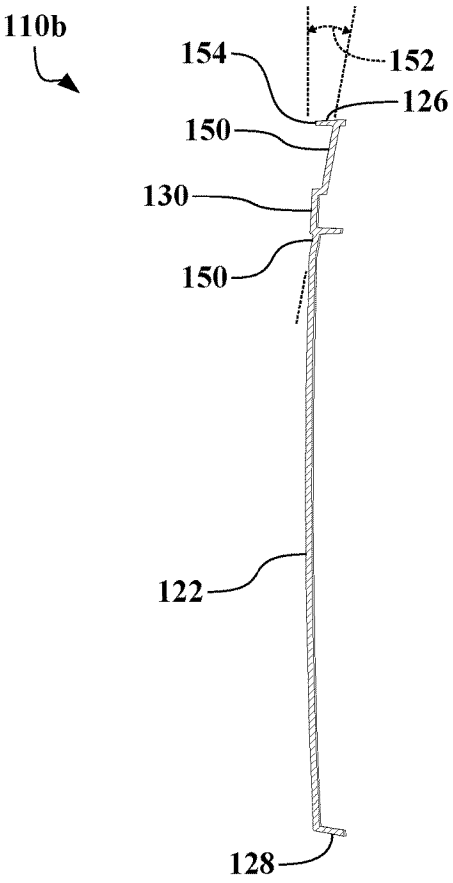
FIG. 10 is a schematic partial cross section of one of the panels, taken generally along a line 10-10 from FIG. 7, illustrating a water trough intersecting a face of the panel and a trough lip at the uppermost edge of the panel.

Referring also to FIG. 10, there is shown a partial cross section, or plane intersection, of one of the panels 110, such as the second panel 110*b* of FIG. 7, taken generally along the line 10-10 of FIG. 7. As shown in FIG. 10, the water trough 150 extends from the trough lip 154 at the upper edge 126 of the panel 110*b* to the face 122 of the panel 110*b*. The view of FIG. 10 further illustrates that the water trough 150 has a planar intersection with the faces 122.

The trough angle 152 generally sets the angle of the plane formed by the water trough 150 relative to its intersection with the faces 122. FIG. 10 also illustrates that the nailing strip 130 raises from within the water trough 150, such that the weeping channels 153 (not viewable in FIG. 10) are formed along the plane of the water trough 150. The weeping channels 153 connect or link all portions of the water trough 150 to the faces 122 and the keyways 124 below, such that water drains downward from all portions of the water trough 150.

The detailed description and the drawings or figures are supportive and descriptive of the invention, but the scope of the invention is defined solely by the claims. While some of the best modes and other embodiments for carrying out the claimed subject matter have been described in detail, various alternative designs, configurations, and embodiments exist for practicing the invention defined in the appended claims.

The invention claimed is:

1. A multi-element panel system configured for attachment to a mounting surface with a plurality of fasteners, comprising:

a first panel having:

an upper portion configured to be oriented upward relative to the mounting surface and a lower portion configured to be oriented downward relative to the mounting surface;

an exterior side configured to be oriented away from the mounting surface and an interior side, a portion of which is configured to contact the mounting surface;

a plurality of faces offset from the interior side and extending substantially continuously from the upper portion to the lower portion, such that the first panel has multiple faces horizontally and only one face vertically;

a water trough formed on the exterior side of the upper portion, wherein the water trough has a planar intersection with the faces and intersects an uppermost edge of the upper portion;

a plurality of keyways one of which is formed between the plurality of faces, wherein the keyways are recessed toward the interior side relative to the faces and extend substantially continuously from the water trough to the lower portion;

a water channel extending substantially continuously between the upper portion and the lower portion of one side of the first panel beyond the faces; and a side lap extending between the upper portion and the lower portion of an opposite side of the first panel from the water channel;

a second panel having:

an upper portion configured to be oriented upward relative to the mounting surface and a lower portion configured to be oriented downward relative to the mounting surface;

an exterior side configured to be oriented away from the mounting surface and an interior side, a portion of which is configured to contact the mounting surface;

a plurality of faces offset from the interior side and extending substantially continuously from the upper portion to the lower portion, such that the second panel has multiple faces horizontally and only one face vertically;

a water trough formed on the exterior side of the upper portion, wherein the water trough has a planar intersection with the faces and intersects an uppermost edge of the upper portion;

a plurality of keyways one of which is formed between the plurality of faces, wherein the keyways are recessed toward the interior side relative to the faces and extend substantially continuously from the water trough to the lower portion;

a water channel extending substantially continuously between the upper portion and the lower portion of one side of the second panel beyond the faces; and a side lap extending between the upper portion and the lower portion of an opposite side of the second panel from the water channel, wherein the side lap of the second panel overlaps the water channel of the first panel;

a horizontal dam formed in the water channel of the first panel and extending away from the exterior side of the first panel;

a horizontal ledge formed on the side lap of the second panel and extending away from the interior side of the second panel, such that the horizontal ledge of the second panel sits within the water channel of the first panel, wherein the horizontal dam of the first panel and the horizontal ledge of the second panel cooperate to define a serpentine path, which requires that water move horizontally in the water channel between the upper portion and the lower portion of the first panel;

a channel lip formed on the water channel of the first panel, wherein the channel lip is opposite the water channel from the faces; and a lap spacer formed on the side lap of the second panel, wherein the horizontal dam of the first panel and the lap spacer of the second panel cooperate to define a minimum horizontal exposure of the overlap of the second panel relative to the first panel;

wherein the channel lip of the first panel and the lap spacer of the second panel cooperate to define a maximum horizontal exposure of the overlap of the second panel relative to the first panel; and wherein the overlap of the second panel relative to the first panel is continuously variable between the minimum horizontal exposure and the maximum horizontal exposure.

2. The multi-element panel system of claim 1, wherein the first panel and the second panel further include:

a plurality of fastener strips formed on and extending from the water trough, such that the fastener strips are at greater elevation than the water trough; and a plurality of weeping channels defined through the fastener strips, such that all portions of the water trough have a flow path to at least one of the faces and the keyways.

3. The multi-element panel system of claim 2, wherein the first panel is formed as a unitary, one-piece component, and the second panel is formed as a unitary, one-piece component.

4. The multi-element panel system of claim 1, wherein the first panel and the second panel further include:

a trough lip formed at the uppermost edge of the upper portion, such that the water trough extends to the trough lip, wherein the trough lip extends from the exterior side away from the mounting surface.

5. A multi-element panel system configured for attachment to a mounting surface with a plurality of fasteners, comprising:

a first panel having:

an upper portion configured to be oriented upward relative to the mounting surface and a lower portion configured to be oriented downward relative to the mounting surface;

a plurality of faces;

a plurality of keyways one of which is formed between the plurality of faces, wherein the keyways are recessed toward the mounting surface relative to the faces;

a water channel extending between the upper portion and the lower portion of one side of the first panel;

a horizontal dam formed in the water channel;

a channel lip formed on the water channel of the first panel; and a side lap extending between the upper portion and the lower portion of an opposite side of the first panel from the water channel;

a second panel having:

an upper portion configured to be oriented upward relative to the mounting surface and a lower portion configured to be oriented downward relative to the mounting surface;

a plurality of faces;

a plurality of keyways one of which is formed between the plurality of faces, wherein the keyways are recessed toward the mounting surface relative to the faces;

a water channel extending between the upper portion and the lower portion of one side of the second panel;

a side lap extending between the upper portion and the lower portion of an opposite side of the second panel from the water channel;

a lap spacer formed on the side lap of the second panel; and a horizontal ledge formed on the side lap;

wherein the side lap of the second panel overlaps the water channel of the first panel;

wherein the horizontal dam of the first panel and the lap spacer of the second panel cooperate to define a minimum horizontal exposure of the overlap of the second panel relative to the first panel; and wherein the channel lip of the first panel and the lap spacer of the second panel cooperate to define a maximum horizontal exposure of the overlap of the second panel relative to the first panel, such that the channel lip of the first panel and the lap spacer of the second panel prevent pulling the side lap of the second panel beyond the water channel of the first panel to prevent a gap between the first panel and the second panel.

6. The multi-element panel system of claim 5, wherein there is continuous adjustability between the maximum horizontal exposure of the overlap of the second panel relative to the first panel and the minimum horizontal exposure of the overlap of the second panel relative to the first panel.

7. The multi-element panel system of claim 6, wherein the first panel and the second panel further include:

a water trough formed on an exterior side of the upper portion, wherein the water trough has a planar intersection with the faces;

a plurality of fastener strips formed in the water trough and extending away from the water trough opposite the mounting surface; and a plurality of weeping channels defined through the fastener strips, such that the weeping channels are recessed toward the mounting surface relative to the fastener strips and all portions of the water trough have a flow path to at least one of the faces and the keyways via the weeping channels.

8. The multi-element panel system of claim 5, wherein there is no direct vertical path through the water channel of the first panel.

* * * * *